US005611740A

United States Patent [19]

Nagamoto

[11] Patent Number: 5,611,740

[45] Date of Patent: Mar. 18, 1997

[54] GOLF CLUB

[75] Inventor: Itsushi Nagamoto, Hamamatsu, Japan

[73] Assignee: Yamaha Corporation, Shizuoka, Japan

[21] Appl. No.: 594,147

[22] Filed: Jan. 31, 1996

[30] Foreign Application Priority Data

Feb. 13, 1995 [JP] Japan ..... 7-046684

[51] Int. Cl.[6] ..... A63B 53/02

[52] U.S. Cl. ..... 473/305; 473/312

[58] Field of Search ..... 473/305, 306, 473/307, 308, 309, 310, 311, 312, 313, 282

[56] References Cited

U.S. PATENT DOCUMENTS 1,202,383 10/1916 Hardman .
1,444,842 2/1923 Lagerblade .
3,519,271 7/1970 Smith .
3,572,709 3/1971 Risher .
4,984,794 1/1991 Pernelle .
5,184,819 2/1993 Desbiolles .

FOREIGN PATENT DOCUMENTS 216725 6/1924 United Kingdom .
2241173 8/1991 United Kingdom .

*Primary Examiner*—Sebastiano Passaniti
*Attorney, Agent, or Firm*—Koda and Androlia

[57] ABSTRACT

A golf club with a head and a hosel which are separate pieces. The hosel connected to the head is made from a material with a low specific gravity and a high strength such as titanium (Ti), a titanium alloy, an aluminum alloy and a fiber-reinforced plastic (FRP), which is different from the material used for the head.

2 Claims, 3 Drawing Sheets

GOLF CLUB

BACKGROUND OF THE INVENTION

1. Field of the Invention

The present invention relates to a golf club such as an iron, wood or putter, and more particularly, to an improvement in the structure for joining the head and hosel part of the golf club.

2. Prior Art

Conventionally, as shown in FIGS. 4 and 5, the head portion of, for example, an iron club is obtained from a head a made of steel (Be—Cu), stainless steel (SuS) or aluminum bronze, etc. and a hosel part (merely called "hosel") b by forging or casting them into an integral unit. The thus obtained head portion is connected to a shaft d by inserting and fastening one end of the shaft d in place into a shaft insertion hole c of the hosel b. A ferrule e, which is plastic, etc., is mounted at the upper end of the hosel b where the shaft d is inserted.

In a golf club having the structure as described above, the head a and hosel b are formed as an integral unit from the same material. Accordingly, if, for example, the head a is made of an iron material, the weight of the hosel b, which is also of an iron material, becomes as heavy as approximately 40 g, thus increasing the overall weight of the head portion. Furthermore, since the head a and hosel b are a single unit, the hosel b is not replaceable. In addition, as seen from FIG. 5, the position of the center of gravity G (or the sweet spot) of the head a is offset toward the upper portion of the head face on the heel side of the head a. Thus, the head a tends to have a high center of gravity.

Furthermore, since the hosel b consists of the same high-rigidity material used for the head a, the ferrule e made of a low-rigidity material such as plastic, etc., must be mounted in the position where stress is concentrated in the shaft d in order to prevent breakage of the shaft d, and this design causes the cost of the golf club to increase.

SUMMARY OF THE INVENTION

Accordingly, the object of the present invention is to provide a golf club, particularly a metal golf club, such as an iron, wood (metal-head wood) or putter, in which the head portion is lightened overall so that the head has a low center of gravity and the cost of the head is low.

It is another object of the present invention to provide a golf club having a replaceable hosel so that the hosel can be changed in terms of performance and external appearance.

The objects of the present invention are accomplished by a unique structure for a golf club wherein the head and the hosel are formed separately and joined together, and the hosel is made from a material with a low specific gravity and a high strength which is different from the material used for the head.

Titanium (Ti), a titanium alloy, an aluminum alloy, a fiber-reinforced plastic (FRP), etc. is suitable as the material for the hosel.

More specifically, in the present invention, the hosel is a separate component from the head and is obtained from a material with a low specific gravity and a high strength that is different from the material used for the head. Accordingly, it is possible to reduce the weight of the hosel. For example, when titanium (approximately 10 g) or a high-aluminum alloy (approximately 6 g) is used as the material of the hosel, the weight of the hosel can be reduced by 20 to 30 g from the weight of a conventional iron hosel which weights approximately 40 g. As a result, the overall weight of the head can be reduced.

Furthermore, since the hosel is light, the position of the center of gravity of the head (or the sweet spot) can be low, and the center of gravity can easily be set in the center of the face of the head, thus making it possible to obtain a head with a low center of gravity.

Moreover, if the head with the hosel of the above structure was designed so as to have the same overall weight as the head of the conventional head, the amount of weight by which the hosel is lightened would be able to be given to and distributed around the periphery of the head. Thus, it is possible for the head to have a wider sweet spot.

In addition, since the head and hosel are separate parts in the present invention, the hosel is replaceable. In other words, the hosel can be changed so as to meet the desired performance and external appearance.

Furthermore, if a material having a low rigidity such as titanium, aluminum, etc. is used for the hosel, the concentration of stress in the shaft is alleviated. Accordingly, breakage of the shaft can be prevented without using a protective member such as a ferrule, etc. which is required in conventional clubs, thus reducing the manufacturing costs.

DETAILED DESCRIPTION OF THE INVENTION

Figure 1:
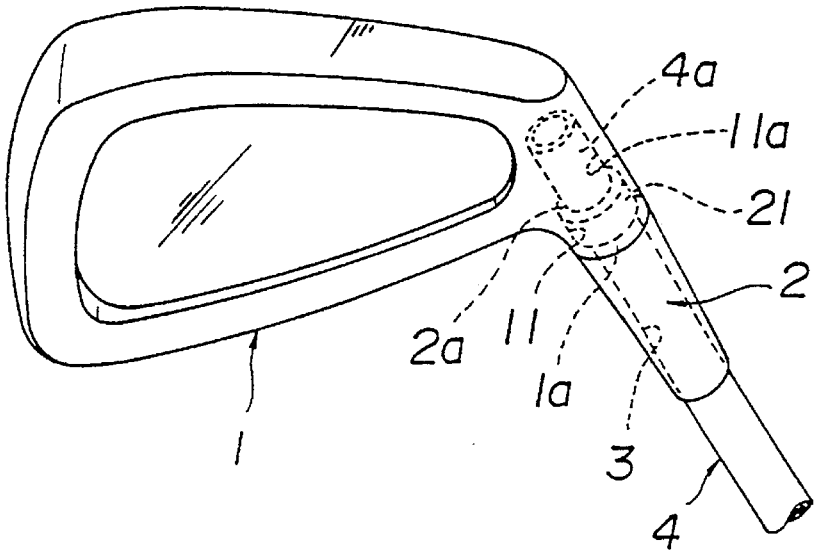
FIG. 1 is an explanatory diagram of an iron club showing a first embodiment of the present invention.
Figure 2:
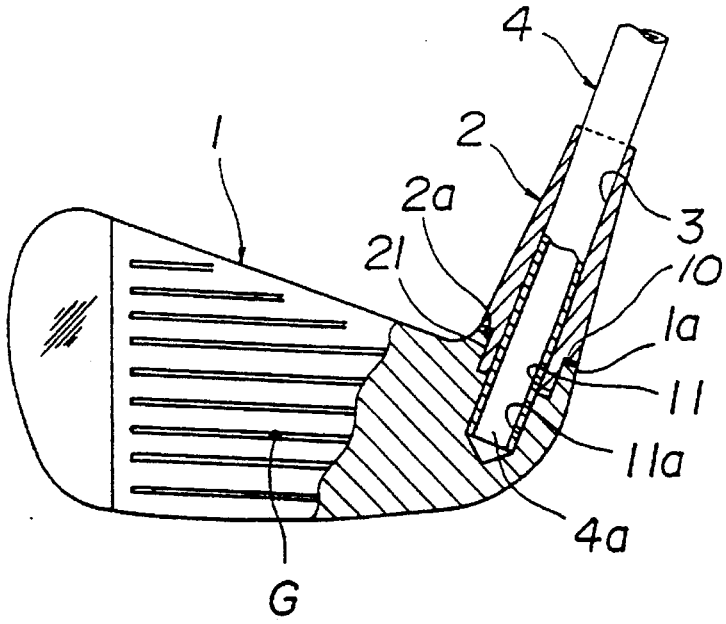
FIG. 2 is a sectional view of the essential portion of the golf club shown in FIG. 1.
Figure 3:
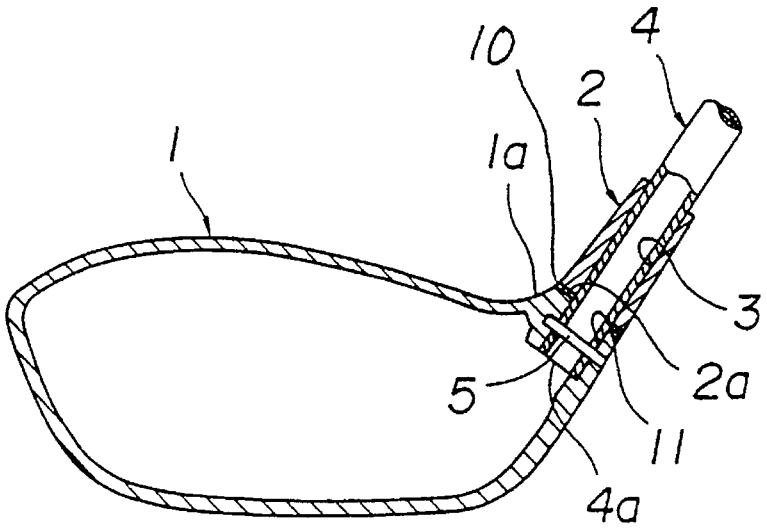
FIG. 3 is a sectional view of a metal wood club showing a second embodiment of the present invention.
Figure 4:
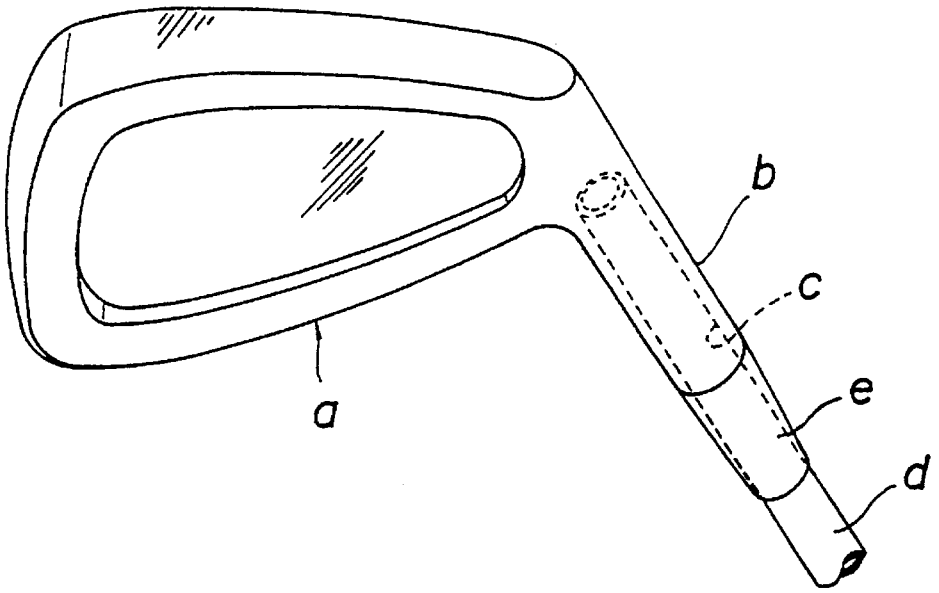
FIG. 4 PRIOR ART
FIG. 4 is an explanatory diagram of a conventional iron club.
Figure 5:
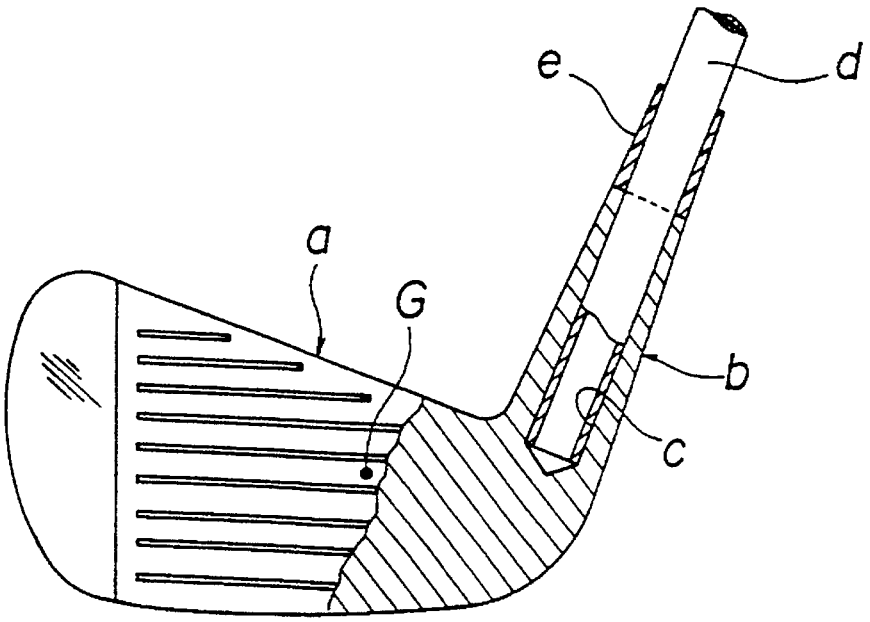
FIG. 5 PRIOR ART
FIG. 5 is a sectional view of the essential parts thereof.

The present invention will be described below in detail with reference to FIGS. 1 through 3. FIGS. 1 and 2 illustrate a first embodiment of the golf club of the present invention, in which the present invention is embodied as an iron.

In FIGS. 1 and 2, the reference numeral 1 indicates a head, and it consists of a metal material such as a soft iron, carbon steel (Be—Cu), stainless steel (SuS), aluminum bronze, etc. The reference numeral 2 indicates a hosel part (merely called "hosel") which is formed separately from the head 1 so as to be joined to the head 1.

More specifically, the hosel 2 is formed from a material with a low specific gravity and a high strength, e.g., titanium (Ti), a titanium alloy, an aluminum alloy, a fiber-reinforced plastic (FRP), etc., which is different from the material used for the head 1.

One end or the tip portion 4*a* of a shaft 4 is inserted and then fastened in place in a shaft insertion hole 3 of the hosel 2. The shaft 4 is provided with a grip (not shown) at another end. The shaft insertion hole 3 is formed so as to extend through the hosel 2 along the central axis thereof.

The hosel 2 is joined to the head 1 in the following manner: the hosel 2 is provided at its lower end 2*a* with an engagement part 21 which is a stepped-down cylindrical projection having a smaller outer diameter than the lower end 2*a*, and this engagement part 21 is inserted into an engagement hole 11 formed in the base end portion 1*a* which is on the heel side of the head 1 so as to be connected to the head 1; and in addition the tip portion 4*a* of the shaft 4 is fastened in place by being inserted into an extended (or deeper) portion 11*a* of the engagement hole 11 of the head 1.

In this case, the shaft 4 is joined to the head 1 and the hosel 2 by an appropriately selected means or method such as screwing, press fitting, shrink fitting, bonding, etc. In addition, a washer 10, made of metal or plastic, for instance, may be provided between the head 1 and the hosel 2. The washer 10 thus inserted prevents vibrations, absorbs shocks and helps parting processing, FIG. 3 illustrates a second embodiment of the present invention which is applied to a wood club. The hosel 2 is formed from a material with a low specific gravity and a high strength such as titanium (Ti), a titanium alloy, an aluminum alloy, a fiber-reinforced plastic (FRP), etc., which is different from the material used for the head 1, and the thus made hosel 2 is joined to the base end portion 1*a* on the heel side of the head 1 which has a metal outer shell structure made of, for example, soft iron, carbon steel (Be—Cu), stainless steel (SuS), aluminum bronze, etc. Furthermore, the tip portion 4*a* of the shaft 4 is inserted into a shaft insertion hole 3 formed in the hosel 2 and further into the engagement hole 11 formed in the base end portion 1*a* on the heel side of the head 1. The shaft 4 is fastened in place by means of glue, etc. and a pin 5 which is inserted from the heel of the head 1.

In the above embodiments, the golf club of the present invention is described with reference to an iron and a wood as examples. However, the present invention can be applied to other types of golf clubs such as putters. In such cases as well, the effects and merits of the present invention are sufficiently exhibited.

As is clear from the above description, in the present invention, the hosel is a separate element from the head and is formed from a material with a low specific gravity and a high strength which is different from the material used to form the head. Accordingly, the hosel is light, and as a result, the overall weight of the head can be light.

Furthermore, as a result of the lightening of the hosel, the position of the center of gravity of the head (or the sweet spot) is low, so that the center of gravity can easily be set in the center of the face of the head, thus making it possible to obtain a head with a low center of gravity.

Moreover, if the overall weight of the head is designed to be the same as in a conventional head, the amount of weight by which the hosel is lightened can be distributed around the periphery of the head. Thus, it is possible to obtain a wider sweet spot in the head.

In addition, since the hosel can be separated from the head, it is possible to replace the hosel. In other words, the hosel can be changed in terms of overall performance and external appearance of a club.

Furthermore, since a material that has a low rigidity such as titanium and aluminum is used for the hosel, the concentration of stress in the shaft is alleviated. Accordingly, breakage of the shaft can be prevented without using a protective member such as a ferrule, etc. which is required in conventional clubs. As a result, a reduction in cost can be achieved.

I claim:

1. A golf club comprising:

a shaft;

a head provided at one end of said shaft, said head being provided with an engagement hole formed in a base end portion of a heel side of said head, said head being formed from a material selected from the group consisting of a soft iron, carbon steel (Be—Cu), and stainless steel SuS); and a hosel provided at said one end of said shaft so that an engagement part formed at one end of said hosel is fitted in said engagement hole of said head, said hosel being formed from a material which is different from said material used for said head and selected from the group consisting of titanium (Ti), and a titanium alloy, having a low specific gravity and a high strength.

2. A golf club according to claim 1, further comprising a washer of constant thickness provided between said head and hosel whereby vibration and shock is prevented.

* * * * *